US006365646B1

(12) United States Patent
Laitar et al.

(10) Patent No.: US 6,365,646 B1
(45) Date of Patent: Apr. 2, 2002

(54) METHOD TO IMPROVE HUMIDITY RESISTANCE OF PHENOLIC URETHANE FOUNDRY BINDERS

(75) Inventors: Robert A. Laitar, Woodridge; Brian K. Teeter; Kwok-tuen Tse, both of Berwyn; Leonid S. Zaretskiy, Chicago, all of IL (US)

(73) Assignee: Borden Chemical, Inc., Columbus, OH (US)

( * ) Notice: Subject to any disclaimer, the term of this patent is extended or adjusted under 35 U.S.C. 154(b) by 0 days.

(21) Appl. No.: 09/456,363

(22) Filed: Dec. 8, 1999

(51) Int. Cl.[7] ..... B22C 1/22
(52) U.S. Cl. ..... 523/143; 523/142
(58) Field of Search ..... 523/143, 142; 524/492, 493, 462

(56) References Cited

U.S. PATENT DOCUMENTS

| | | | | |
|---|---|---|---|---|
| 3,676,392 A | | 7/1972 | Robins | 260/38 |
| 4,028,271 A | | 6/1977 | Schaidle et al. | 252/429 |
| 4,108,826 A | | 8/1978 | Anderson et al. | 260/395 |
| 4,200,706 A | | 4/1980 | Starks | 525/502 |
| 4,268,425 A | | 5/1981 | Gardikes | 260/19 |
| 4,287,092 A | | 9/1981 | Stewart et al. | 252/429 |
| 4,410,595 A | | 10/1983 | Matsumoto et al. | 428/412 |
| 4,423,185 A | | 12/1983 | Matsumoto et al. | 525/66 |
| 4,448,234 A | * | 5/1984 | Kelley et al. | 164/16 |
| 4,495,316 A | | 1/1985 | Armbruster | 523/139 |
| 5,211,215 A | | 5/1993 | Sommer | 164/5 |
| 5,503,937 A | | 4/1996 | Bertram et al. | 428/414 |
| 5,911,269 A | * | 6/1999 | Brander et al. | 164/523 |
| 6,017,978 A | * | 1/2000 | Chen et al. | 523/143 |

FOREIGN PATENT DOCUMENTS

| | | | |
|---|---|---|---|
| EP | 0 183 280 A2 | 6/1986 | C07F/7/18 |
| WO | WO99/03641 | 1/1999 | B22C/5/18 |

* cited by examiner

*Primary Examiner*—Edward J. Cain
*Assistant Examiner*—Katarzyna W. Lee
(74) *Attorney, Agent, or Firm*—Gardner, Carton & Douglas

(57) ABSTRACT

An embodiment of the present invention provides a method for improving the tensile strength of foundry cores and molds. More particularly, an embodiment of the present invention provides an improved binder for foundry cores and molds that include a fluoride bearing acid in combination with an inorganic silicon compound. Alternately, the improved binder may include a fluoride bearing acid in combination with a boron compound. In a preferred embodiment, a modified part 1 binder component includes a combination of hydrofluoric acid and an inorganic silicon compound.

23 Claims, No Drawings

METHOD TO IMPROVE HUMIDITY RESISTANCE OF PHENOLIC URETHANE FOUNDRY BINDERS

FIELD OF THE INVENTION

The present invention relates to an improved phenolic urethane binder composition to bind foundry cores and molds. The present invention also relates to a method for improving the strength of foundry cores and molds made using such a binder and in particular the humidity resistance of such cores and molds. This invention further relates to the reaction product of an acidic fluoride compound, and silicon dioxide useful in phenolic urethane foundry binder compositions for the improvement of humidity resistance.

BACKGROUND OF THE INVENTION

Phenolic urethane binders or binder systems for foundry cores and molds are known. In the foundry art, cores or molds for making metal castings are normally prepared from a mixture of an aggregate material, such as sand, and a binding amount of a binder or binder system. Typically, after the aggregate material and binder have been mixed, the resulting mixture is rammed, blown or otherwise formed to the desired shape or pattern of the core or mold, and then cured to a solid.

Generally, resin binders used in the production of foundry molds and cores may be cured at high temperatures to achieve the fast-curing cycles required in foundries. However, resin binders have been developed which cure at low temperatures. These processes are preferred over high-temperature curing operations that have higher energy requirements and often emit undesirable fumes. Also, these processes offer productivity advantages over the high-temperature curing operations.

One group of processes which do not require heating in order to achieve curing of the resin binder are referred to as phenolic urethane nobake processes. In such processes, the binder components are coated on the aggregate material, such as sand, and the resulting mixture is rammed, blown or otherwise formed to the desired shape or pattern, either a core or mold. Curing of the binder is achieved without heating. In these processes, the binder components typically include a part 1 binder component, a part 2 binder component and a liquid catalyst.

Another process, which does not require the application of heat to cure a core or mold, is the cold box process. In this process, a foundry core or mold is prepared by mixing sand with a two component binder, discharging the mixture into a pattern, and curing the mixture by contacting the binder with a vaporous catalyst.

As alluded to above, the binder for the urethane cold-box or nobake systems is a two-part composition. The part 1 component of the binder is a polyol (comprising preferably hydroxy containing phenol-formaldehyde resins) and the part 2 component is an isocyanate (comprising preferably polyaryl polyisocyanates). Both parts are in a liquid form and are generally used in combination with organic solvents. To form the binder and thus the foundry sand mixture, the part 1 component and the part 2 component are combined. After a uniform mixture of the foundry sand and parts 1 and 2 is achieved, the foundry mix is formed or shaped as desired. Parts 1 and/or 2 may contain additional components such as, for example, mold release agents, plasticizers, inhibitors, and the like.

Liquid amine catalysts and metallic catalysts, known in the urethane art, are employed in a no-bake composition.

The catalyst may be incorporated into either the part 1 component or the part 2 component of the binder or it may be added after uniform mixing as a third part. By selection of a proper catalyst, conditions of the core making process, for example, worktime and strip time, can be adjusted.

In cold box technology, the curing step is accomplished by suspending a tertiary amine catalyst in an inert gas stream and passing the gas stream containing the tertiary amine, under sufficient pressure to penetrate the molded shape until the resin is cured.

Improvements in resinous binder systems which can be processed according to the cold box or nobake process generally arise by modifying the binder components, i.e., either the polyol part or the isocyanate part. For instance, U.S. Pat. No. 4,546,124, which is incorporated herein by reference, describes an alkoxy modified phenolic resin as the polyhydroxy component. The modified phenolic resin improves the hot strength of the binder systems. U.S. Pat. No. 5,189,079, which is herein incorporated by reference, discloses the use of a modified resole resin. These resins are desired because they emit reduced amounts of formaldehyde. U.S. Pat. No. 4,293,480, herein incorporated by reference, relates to improvements in the isocyanate component, which enhances shake-out properties of non-ferrous castings.

One of the shortcomings of the phenolic urethane cold box binders is that, under humid condition, specimens made with this type of binder system deteriorate substantially. Humidity is a concern because its effect is to reduce the tensile strength of produced cores. The presence of water or water vapor can react with any unreacted isocyanate, thus producing a weak, undesirable chemical structure. Also, the presence of excessive water or water vapor can cause a drop in tensile strength of cured prior art cores exposed to these conditions. The effect may even be insidious, as other more easily measured parameters such as cure time, may not be influenced, thus providing the user of a binder with a false sense of security. Hundreds of cores may be produced before the affects of humidity become apparent. Accordingly, the ability to improve humidity resistance is a significant advance in the art.

Fluoride, including hydrofluoric acid, modifications of resin binder systems are known. A range of benefits, such as faster cure speed, humidity resistance, improved collapsibility, have been reported. However, the use of hydrofluoric acid alone, for example, produced highly variable results with respect to improved humidity resistance. Accordingly, the use of hydrofluoric acid alone has long been considered undesirable.

It would therefore be an advantage to have a phenolic urethane binder system that provides significantly stronger cores and molds under high humidity conditions. It would be yet a further advantage to have a method for improving the humidity resistance of cores and molds bound with a phenolic urethane resin. It would be an even further advantage to provide an additive to phenolic urethane binders thereby providing additional humidity resistance to the cured resin.

SUMMARY OF THE INVENTION

Unexpectedly, in view of the foregoing difficulties, it has now been discovered that the tensile strength in cured cores and molds may be improved by using a new and improved phenolic urethane binder, or, as an alternative embodiment, a new and improved additive. In one embodiment, the new and improved phenolic urethane binder comprises a phenolic resole, hydrofluoric acid and an inorganic silicon compound. In another embodiment, the new and improved phenolic urethane binder comprises hydrofluoric acid and a boron compound. In yet other embodiments, the new and improved phenolic urethane binder includes, other silicon bearing compounds and other fluoride bearing acids. In an alternative embodiment of the present invention, an additive for improving the humidity resistance of foundry cores and molds comprises hydrofluoric acid and an inorganic silicon compound. In another embodiment, the additive comprises hydrofluoric acid and a boron compound.

A major advantage provided in accordance with the invention is that significantly stronger cores and molds are provided than were heretofore obtainable under high humidity conditions with prior art phenolic urethane binder systems. Another advantage provided by the present invention is that a new additive is provided that realizes the synergistic benefits from combining a fluoride bearing acid with a silicon or boron compound. A further advantage provided by the present invention is that cured foundry shaped articles having improved humidity resistance may be provided. Still another advantage is that a new and improved method for improving the humidity resistance of cores and molds with a phenolic urethane binder is provided.

Other aspects and advantages of the present invention will become apparent from the following Detailed Description and the examples.

DETAILED DESCRIPTION OF THE INVENTION

According to one embodiment of the present invention, there is provided a composition that results in an increased humidity resistance of foundry cores and molds as compared to the prior art. It has been discovered that a combination of a fluoride bearing acid and a silicon compound when used in a phenolic urethane binder provides shaped articles exhibiting unexpected improved mechanical properties including improved strength. It has further been discovered that a combination of a fluoride bearing acid and a boron compound when used in a phenolic urethane binder also provides improved strength.

The composition of one embodiment of the present invention is useful as a foundry binder. Such a foundry binder will bind together aggregate material, typically sand, in a preformed shape. A foundry core or mold is typically prepared by mixing sand with a part 1 binder component, a part 2 binder component, and applying either a liquid or vaporous catalyst. The part 1 binder component and the part 2 binder component in combination form a binder. In the nobake process, referred to above, the part 1 binder component, part 2 binder component and a liquid catalyst are mixed with a foundry aggregate. This mixture is then discharged into a pattern and cured. Similarly, in the cold box process a foundry core or mold is prepared by mixing sand with a part 1 binder component and a part 2 binder component, discharging the mixture into a pattern, and curing the mixture by passing a vaporous catalyst through the mixture of sand and resin.

In an embodiment of the present invention, a part 1 binder component is modified by combining a resole with a combination of hydrofluoric acid and a silicon compound and other components. In an alternate embodiment of the present invention, a part 1 binder component is modified by combining a resole with a combination of hydrofluoric acid and a boron compound. A part 1 binder component modified according to the principles of the present invention is useful, in combination with a part 2 binder component and a catalyst, also described above, in making a binder for foundry cores and molds. The foundry cores and molds made using such a binder demonstrate improvements in tensile strength when exposed to high humidity over cores and molds made using the binders of the prior art. In an alternative embodiment, the combination of hydrofluoric acid and either a silicon compound or a boron compound may be separately added to either the aggregate material, the part 1 binder component, or the part 2 binder component. It should be noted that a modified binder component of the present invention, that is a binder component containing a fluoride bearing acid and either a silicon compound or a boron compound as disclosed herein, is a liquid mixture having a viscosity that is not significantly different from the unmodified counterpart.

Combination of Fluoride Bearing Acid and Silicon or Boron Compounds

It has been discovered that a combination of a fluoride bearing acid and an silicon compound when used in a phenolic urethane binder provides shaped articles exhibiting unexpected improved mechanical properties including improved strength. It has been further discovered that the benefits may be realized using combinations of hydrofluoric acid and a variety of silicon compounds. Additionally, other compounds may be used with the combination of hydrofluoric acid and silicon to enhance the benefits otherwise realized with the combination. It has also been discovered that boron compounds, such as boric acid, may be combined with a fluoride bearing acid, such as hydrofluoric acid, to generate unexpected improvements in the humidity resistance of cores and molds incorporating such a combination.

The silicon compounds may include silica flour, silica gel, colloidal silica, fumed silica, ground soda glass, and the like. VEINGUARD, a product of Borden Chemical, Inc., Louisville, Ky., a material containing soda-lime cullet, may also be used. The silicon compounds may further include sodium silicate, magnesium silicate, calcium silicate, and sodium aluminosilicate. Particularly, in one embodiment, the silicon compounds of the present invention are inorganic oxides of silicon. Furthermore, in one embodiment, the silicon compounds of the present invention may be characterized by having at least one oxygen atom bound directly to the silicon atom. However, silicon metal and silicon bearing minerals, such as ferrosilicon and iron silicide, are also useful in the present invention. The silicon compounds of the present invention, hereinafter generally referred to as inorganic silicon compounds, are thus distinguishable from silanes are not intended to include silanes. Silanes will include at least one organic substituent and are often referred to in the art as organosilanes.

The fluoride bearing acid is typically hydrofluoric acid; however, other fluoride bearing acids may be used with embodiments of the present invention. These other acids include, for example, fluorosilicic acid and fluoroboric acid. The fluoride bearing acids may be used in concentrations that are generally commercially available or otherwise obtainable. For example, hydrofluoric acid may be used as a 48% w/w aqueous solution, however, other concentrations, such as a 70% w/w aqueous solution, may also be used in embodiments of the present invention.

The amount of inorganic silicon compound and the amount of fluoride bearing acid may vary over a broad range. The inorganic silicon compound is typically used in an amount that ranges from about 0.01% to about 1%, calculated as silicon and based on the weight of the part 1 binder component. Preferably, the inorganic silicon compound is used in an amount that ranges from about 0.02% to about 0.5%, calculated as silicon and based on the weight of the part 1 binder component. The fluoride bearing acid is typically used in an amount that ranges from about 0.1% to about 2%, calculated as hydrogen fluoride and based on the weight of the part 1 binder component. Preferably, the fluoride bearing acid is used in an amount that ranges from about 0.1% to about 0.8%, calculated as hydrogen fluoride and based on the weight of the part 1 binder component. The inorganic silicon compound and the fluoride bearing acid may be added separately to the part 1 binder component. However, the inorganic silicon compound and the fluoride bearing acid may be combined and reacted, and the mixture thus formed added to the part 1 binder component. Preferably, a modified part 1 binder component is prepared containing an inorganic silicon compound and hydrofluoric acid. Alternately, an inorganic silicon compound and a fluoride bearing acid may be separately, or in combination, mixed with solvents and the mixture or mixtures added to the part 1 binder component, the part 2 binder component, or the aggregate, at the time a foundry mix is made. It can thus be seen that the weight ratio of fluoride bearing acid to the inorganic silicon compound can range from about 20:1 to about 1:20, preferably from about 20:1 to about 1:2, calculated as hydrogen fluoride and silicon respectively.

As used herein, the weight of fluoride bearing acid calculated as hydrogen fluoride means the weight of hydrogen fluoride equivalents present in the fluoride bearing acid used. Similarly, the weight of inorganic silicon compound calculated as silicon means the weight of silicon equivalents present in the inorganic silicon compound used. Likewise, the weight of boron compound calculated as boron means the weight of boron equivalents present in the boron compound used.

As noted above, it has also been discovered that a fluoride bearing acid in combination with a boron compound produces unexpected improvements in humidity resistance. The fluoride bearing acid is typically used in an amount that ranges from about 0.1% to about 2%, calculated as hydrogen fluoride and based on the weight of the part 1 binder component. Preferably, the fluoride bearing acid is used in an amount that ranges from about 0.1% to about 0.8%, calculated as hydrogen fluoride and based on the weight of the part 1 binder component. The boron compound is typically used in an amount that ranges from about 0.01% to about 1%, calculated as boron and based on the weight of the part 1 binder component. Preferably, the boron compound is used in an amount that ranges from about 0.05% to about 0.5%, calculated as boron and based on the weight of the part 1 binder component. The boron compound and the fluoride bearing acid may be added separately to the part 1 binder component. However, the boric acid and the hydrofluoric acid may be combined and reacted, and the mixture thus formed added to the part 1 binder component. Preferably, a modified part 1 binder component is prepared that contains boric acid and hydrofluoric acid. Alternately, the boron compound and the fluoride bearing acid may be separately, or in combination, mixed with solvents and the solvent mixture or mixtures added to the part 1 binder component, the part 2 binder component, or the aggregate, at the time a foundry mix is made. From the foregoing, it can be seen that the weight ratio of fluoride bearing acid to the boron compound can range from about 20:1 to about 1:20, calculated as hydrogen fluoride and boron respectively.

Part 1 Binder Component

Typically, the part 1 binder component is a phenolic resole resin in a solution of organic solvents and/or plasticizers. One preferred part 1 binder component is SIGMA CURE 7121, made and sold by Borden Chemical, Inc., Louisville, Ky. This binder component has a viscosity of about 300 cps, a solids content of about 57%, free phenol content of about 5%, and a free formaldehyde of less than 0.1%. SIGMA CURE 7121 is typically used in a cold box process. Another preferred part 1 binder component useful in the cold box process is SIGMA CURE PM14, also made and sold by Borden Chemical, Inc., Louisville, Ky. This binder component has a viscosity of about 220 cps, a solids content of about 57%, a free phenol content of about 5%, and a free formaldehyde content of less than 0.1%.

A preferred part 1 binder component useful in the nobake process is SIGMA SET 6100, made and sold by Borden Chemical, Inc., Louisville, Ky. This binder component has a viscosity of about 110 cps, a solids content of about 57%, free phenol content of about 5%, and a free formaldehyde of less than 0.1%.

Phenolic Resole

Resole resins are thermosetting, i.e., they form an infusible three-dimensional polymer upon application of heat and are produced by the reaction of a phenol and a molar excess of a phenol-reactive aldehyde typically in the presence of an alkali, alkaline earth, or other metal compound as a condensing catalyst.

The phenolic resole which may be used with the embodiments of the present invention may be obtained by the reaction of a phenol, such as phenol itself, cresol, resorcinol, 3,5-xylenol, bisphenol-A, other substituted phenols, and mixtures of any of these compounds, with an aldehyde such as, for example, formaldehyde, paraformaldehyde, acetaldehyde, furfuraldehyde, and mixtures of any of these aldehydes.

A broad range of phenolic resoles in fact may be used with the various embodiments of this invention. These can be phenol-formaldehyde resoles or those where phenol is partially or completely substituted by one or more reactive phenolic compounds and the aldehyde portion can be partially or wholly replaced by other aldehyde compounds. The preferred phenolic resole resin is the condensation product of phenol and formaldehyde.

Any of the conventional phenolic resole resins or alkoxy modified resole resins may be employed as the phenolic resin with the present invention. Of the alkoxy modified resole resins, methoxy modified resole resins are preferred. However, the phenolic resole resin which is most preferred is the modified orthobenzylic ether-containing resole resin prepared by the reaction of a phenol and an aldehyde in the presence of an aliphatic hydroxy compound containing two or more hydroxy groups per molecule. In one preferred modification of the process, the reaction is also carried out in the presence of a monohydric alcohol.

Phenols suitable for preparing the modified orthobenzylic ether-containing phenolic resole resins are generally any of the phenols which may be utilized in the formation of phenolic resins, and include substituted phenols as well as unsubstituted phenol per se. The nature of the substituent can vary widely, and exemplary substituted phenols include alkyl-substituted phenols, aryl-substituted phenols, cycloalkyl-substituted phenols, alkenyl-substituted phenols, alkoxy-substituted phenols, aryloxy-substituted phenols and halogen-substituted phenols. Specific suitable exemplary phenols include in addition to phenol per se, o-cresol, m-cresol, p-cresol, 3,5-xylenol, 3,4-xylenol, 3,4,5-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, and p-phenoxy phenol. A preferred phenolic compound is phenol itself.

The aldehyde employed in the formation of the modified phenolic resole resins can also vary widely. Suitable aldehydes include any of the aldehydes previously employed in the formation of phenolic resins, such as formaldehyde, acetaldehyde, propionaldehyde and benzaldehyde. In general, the aldehydes employed contain from 1 to 8 carbon atoms. The most preferred aldehyde is an aqueous solution of formaldehyde.

Metal ion catalysts useful in production of the modified phenolic resins include salts of the divalent ions of Mn, Zn, Cd, Mg, Co, Ni, Fe, Pb, Ca and Ba. Tetra alkoxy titanium compounds of the formula $Ti(OR)_4$ where R is an alkyl group containing from 3 to 8 carbon atoms, are also useful catalysts for this reaction. A preferred catalyst is zinc acetate. These catalysts give phenolic resole resins wherein the preponderance of the bridges joining the phenolic nuclei are ortho-benzylic ether bridges.

A molar excess of aldehyde per mole of phenol is used to make the modified resole resins. Preferably the molar ratio of phenol to aldehyde is in the range of from about 1:1.1 to about 1:2.2. In a preferred embodiment, the phenol and aldehyde are reacted in the presence of the divalent metal ion catalyst at pH below about 7. A convenient way to carry out the reaction is by heating the mixture under reflux conditions. Reflux, however, is not required.

In one embodiment, an aliphatic hydroxy compound which contains two or more hydroxy groups per molecule is added to the reaction mixture. The hydroxy compound is added at a molar ratio of hydroxy compound to phenol of from about 0.001:1 to about 0.03:1. This hydroxy compound may be added to the phenol and aldehyde reaction mixture at any time when from 0% (i.e., at the start of the reaction) to when about 85% of the aldehyde has reacted. It is preferred to add the hydroxy compound to the reaction mixture when from about 50% to about 80% of the aldehyde has reacted. Useful hydroxy compounds which contain two or more hydroxy groups per molecule are those having a hydroxyl number of from about 200 to about 1850. Suitable hydroxy compounds include ethylene glycol, propylene glycol, 1,3-propanediol, diethylene glycol, triethylene glycol, glycerol, sorbitol and polyether polyols having hydroxyl numbers greater than about 200. Glycerol is a particularly suitable hydroxy compound.

The reaction mixture, is typically heated until from about 80% to about 98% of the aldehyde has reacted. Although the reaction can be carried out under reflux until about 98% of the aldehyde has reacted, prolonged heating is required and it is preferred to continue the heating only until about 80% to 90% of the aldehyde has reacted. At this point, the reaction mixture is heated under vacuum at a pressure of about 50 mm of Hg until the free formaldehyde in the mixture is less than about 1%. Preferably, the reaction is carried out at 95° C. until the free formaldehyde is less than about 0.1% by weight of the mixture. The catalyst may be precipitated from the reaction mixture before the vacuum heating step if desired. Citric acid may be used for this purpose. The modified phenolic resole may be "capped" to be an alkoxy modified phenolic resole resin. In capping, a hydroxy group is converted to an alkoxy group by conventional methods that would be apparent to one skilled in the art given the teachings of the present disclosure.

Part 2 Binder Component

Typically, the part 2 binder component is a polymeric isocyanate in a solution of organic solvents and/or plasticizers. One preferred part 2 binder component is SIGMA CURE 7515, made and sold by Borden Chemical, Inc., Louisville, Ky. This binder component has a viscosity of about 29 cps, and a solids content of about 80%. SIGMA CURE 7515 is typically used in a cold box process. Another preferred part 2 binder component useful in the cold box process is SIGMA CURE PM25, also made and sold by Borden Chemical, Inc., Louisville, Ky. This binder component has a viscosity of about 45 cps, and a solids content of about 75%.

A preferred part 2 binder component useful in the nobake process is SIGMA SET 6500, made and sold by Borden Chemical, Inc., Louisville, Ky. This binder component has a viscosity of about 78 cps, and a solids content of about 71%.

Isocyanates

The isocyanate component which can be employed in a binder according to this invention may vary widely and includes polyisocyanates. As defined herein, polyisocyanates includes isocyanates having such functionality of 2 or more, e.g., diisocyanates, triisocyanates, etc. Exemplary of the useful isocyanates are organic polyisocyanates such as tolylene-2,4-diisocyanate, tolylene-2,6-diisocyanate, and mixtures thereof, particularly crude mixtures thereof that are commercially available. Other typical polyisocyanates include methylene-bis-(4-phenyl isocyanate), n-hexyl diisocyanate, naphthalene-1,5-diisocyanate, cyclopentylene-1,3-diisocyanate, p-phenylene diisocyanate, tolylene-2,4,6-triisocyanate, and triphenylmethane-4,4',4"-triisocyanate. Higher isocyanates are provided by the reaction products of (1) diisocyanates and (2) polyols or polyamines and the like. In addition, isothiocyanates and mixtures of isocyanates can be employed. Also contemplated are the many impure or crude polyisocyanates that are commercially available. Especially preferred for use in the invention are the polyaryl polyisocyanates. The preferred polyisocyanate may vary with the particular system in which the binder is employed.

Solvents/Plasticizers

As discussed above, the part 1 binder component and the part 2 binder component are typically dissolved in solvents and/or plasticizers (hereinafter generally referred to as solvents). The solvents provide component solvent mixtures of desirable viscosity and facilitate coating foundry aggregates with the part 1 and part 2 binder components. While the total amount of a solvent can vary widely, it is generally present in a composition of this invention in a range of from about 5% to about 70% by weight, based on the total weight of the part 1 binder component, and is preferably present in a range of from about 20% to about 60% by weight. With respect to the part 2 binder component, the solvent is generally present in a range of from about 1% to about 50% by weight, based on the total weight of the part 2 binder component, and is preferably present in a range of from about 5% to about 40% by weight.

The solvents employed in the practice of this invention are generally hydrocarbon and polar organic solvents such as organic esters. Typically, the part 1 component may contain a mixture of hydrocarbon and polar solvents, while, typically, the part 2 component contains hydrocarbon solvents. Suitable exemplary hydrocarbon solvents include aromatic hydrocarbons such as benzene, toluene, xylene, ethyl benzene, high boiling aromatic hydrocarbon mixtures, heavy aromatic naphthas and the like. A biphenyl compound or a mixture of biphenyl compounds, when used as an additive per se or as a substitute for a portion or part of the solvents. Preferably the biphenyl substitute is a mixture of substituted lower alkyl ($C_1$–$C_6$) compounds. A preferred composition comprises a mixture of compounds having di- and tri-substitution sold by Koch Chemical Company of Corpus Christi, Tex., as SURE-SOL 300, which is a mixture of diisopropylbiphenyl and triisopropylbiphenyl compounds. Paraffinic oil may also be used and may be any of a number of viscous pale to yellow conventional refined mineral oils. For example white mineral oils may be employed in the present invention. The paraffinic oil may be in the phenolic resin component, the isocyanate component, or both components. A preferred paraffinic oil is SEMTOL 70, manufactured by Witco Chemical Co., New York, N.Y.

A variety of ester-functional solvents are useful in embodiments of the present invention. Organic mono esters (long-chain esters), dibasic acid ester and/or fatty acid ester blends increase the polarity of the formulation and thus promote incorporating the aliphatic paraffinic oils in the more polar formulation. Long-chain esters, such as glyceryltrioleate, are also useful in the embodiments of the present invention. The aliphatic "tail" of such an ester is compatible with non-polar components, while the ester "head" of the ester is compatible with the polar components. The use of a long-chain ester thus allows a balancing of polar character which facilitates the incorporation of non-polar component into a more polar system.

Although the solvents employed in combination with either the part 1 binder component or the part 2 binder component do not, to any significant degree, enter into the reaction between parts one and two, they can affect the reaction. Thus, the difference in polarity between a polyisocyanate and a polyol restricts the choice of solvents (and plasticizers for that matter) in which both part 1 and part 2 components are compatible. Such compatibility is necessary to achieve complete reaction and curing of the binder composition.

Coupling Agents and Additives

Silanes are commonly added to phenolic foundry resins to improve the adhesion to the sand and the tensile strengths of the molds and cores produced from the resins. Amounts as low as 0.05% by weight, based on the weight of the part 1 or part 2 binder components, have been found to provide significant improvements in tensile strength. Higher amounts of silane can generate greater improvements in strength up to quantities of about 0.6% by weight or more. The silanes are used in a quantity sufficient to improve adhesion between the resin and aggregate. Typical usage levels of these silanes are 0.1 to 1.5% based on resin weight. Useful silanes include γ-aminopropyltriethoxysilane, 2-(3, 4-epoxycyclohexyl)ethyl trimethoxysilane, bis (trimethoxysilylpropyl)ethylenediamine, N-trimethoxysilylpropyl-N,N,N-trimethylammonium chloride and secondary amino silane.

In the practice of this invention, additives normally utilized in foundry manufacturing processes can also be added to the compositions during the sand coating procedure. Such additives include materials such as iron oxide, clay, carbohydrates, potassium fluoroborates, wood flour and the like.

Catalysts

As previously noted above, the compositions of this invention can be cured by both the cold box and nobake processes. The compositions are cured by means of a suitable catalyst. While any suitable catalyst for catalyzing the reaction between the part 1 binder component and part 2 binder component may be used, it is to be understood that when employing the cold box process, the catalyst employed is generally a volatile catalyst. On the other hand, where the nobake process is employed, a liquid catalyst is generally utilized. Moreover, no matter which process is utilized, that is, the cold box or the nobake process, at least enough catalyst is employed to cause substantially complete reaction of the part 1 binder component and the part 2 binder component.

Liquid amine catalysts and metallic catalysts employed in the nobake process may be in either part 1 and/or part 2 binder components or added to a mixture of parts 1 and 2. In the cold box process, tertiary amine catalysts are employed by being carried by an inert gas stream through a molded article until curing is accomplished.

Preferred exemplary catalysts employed when curing the compositions of this invention by the cold box process are volatile basic catalysts, e.g., tertiary amine gases, which are passed through a core or mold generally along with an inert carrier, such as air or carbon dioxide. Exemplary volatile tertiary amine catalysts which result in a rapid cure at ambient temperature that may be employed in the practice of the present invention include trimethyl-amine, triethylamine and dimethylethylamine and the like.

On the other hand, when utilizing the compositions of this invention in the nobake process, liquid tertiary amine catalysts are generally and preferably employed. Exemplary liquid tertiary amines which are basic in nature include those having a $pK_b$ value in a range of from about 4 to about 11. The $pK_b$ value is the negative logarithm of the dissociation constant of the base and is a well-known measure of the basicity of a basic material. The higher the number is, the weaker the base. Bases falling within the mentioned range are generally, organic compounds containing one or more nitrogen atoms. Preferred among such materials are heterocyclic compounds containing at least one nitrogen atom in the ring structure. Specific examples of bases which have a $pK_b$ value within the range mentioned include 4-alkylpyridines wherein the alkyl group has from 1 to 4 carbon atoms, isoquinoline, arylpyridines, such as phenyl pyridine, acridine, 2-methoxypyridine, pyridazines, 3-chloropyridine, and quinoline, N-methylimidazole, N-vinylimidazole, 4,4'-dipyridine, 1-methylbenzimidazole and 1,4-thiazine. Additional exemplary, suitable preferred catalysts include, but are not limited to, tertiary amine catalysts such as N,N-dimethylbenzylamine, triethylamine, tribenzylamine, N,N-dimethyl-, 3-propanediamine, N,N-dimethylethanolamine and triethanolamine. It is to be understood that various metal organic compounds can also be utilized alone as catalysts or in combination with the previously mentioned catalyst. Examples of useful metal organic compounds which may be employed as added catalytic materials are cobalt naphthenate, cobalt octoate, dibutyltin dilaurate, stannous octoate and lead naphthenate and the like. When used in combinations, such catalytic materials, that is the metal organic compounds and the amine catalysts, may be employed in all proportions with each other.

It is further understood that when utilizing the compositions of this invention in the nobake process, the amine catalysts, if desired, can be dissolved in suitable solvents such as, for example, the hydrocarbon solvents mentioned above. The liquid amine catalysts are generally employed in a range of from about 0.5% to about 15% by weight, based on the weight of the part 1 binder component present in a composition in accordance with the invention.

When employing a binder composition of this invention in the nobake process, the curing time can be controlled by varying the amount of catalyst added. In general, as the amount of catalyst is increased, the cure time decreases.

Curing of the binders of the present invention generally takes place at ambient temperature without the need for subjecting the compositions to heat. However, in usual foundry practice preheating of the sand is often employed to raise the temperature of the sand to accelerate the reactions and control temperature and thus, provide a substantially uniform operating temperature on a day-to-day basis. The sand is typically preheated to from about 30° F. up to as high as 120° F. and preferably up to about 75° F. to 100° F. However, such preheating is neither critical nor necessary in carrying out the practice of this invention.

Aggregate

The aggregate material commonly used in the foundry industry include silica sand, construction aggregate, quartz, chromite sand, zircon sand, olivine sand, or the like. Reclaimed sand, that is sand that may have been previously bonded with a phenolic urethane binder may also be used.

Sand sold under the product designation F-5574, available from Badger Mining Corporation, Berlin, Wis., is useful in making cores and molds of the embodiments of the present invention. Likewise, sand sold under the product designation Wedron 530, available from Wedron Silica, a division of Fairmount Minerals, Wedron, Ill., is also useful. Sand sold under the product designation Nugent 480, available from Nugent Sand Company, Muskegon, Mich., may also be used. As known in the art, the sand type will affect the strength development of the bound aggregate.

Foundry Cores and Molds

In general, the process for making foundry cores and molds in accordance with an embodiment of this invention comprises admixing aggregate material with at least a binding amount of the part 1 binder component and the part 2 binder component. A mixture of a fluoride bearing acid and a silicon or boron compound may be added to the aggregate material. Preferably, the process for making foundry cores and molds in accordance with this invention includes admixing aggregate material with at least a binding amount of a modified part 1 binder component containing a mixture of hydrofluoric acid and an inorganic silicon compound described above. Alternately, a modified part 1 binder component containing a mixture of hydrofluoric acid and boric acid is preferred.

In general, the process for making foundry cores and molds in accordance with this invention comprises admixing aggregate material with at least a binding amount of the part 1 and part 2 binder components. Preferably, the process for making foundry cores and molds in accordance with this invention comprises admixing aggregate material with at least a binding amount of a modified part 1 binder component of the present invention. A part 2 binder component is added and mixing is continued to uniformly coat the aggregate material with the part 1 and part 2 binder components. In the nobake process, a sufficient amount of catalyst is added to catalyze the reaction between the components. The admixture is suitably manipulated, as for example, by distributing the same in a suitable core box or pattern. In the cold box process, a sufficient amount of catalyst is applied to the uncured core or mold to catalyze the reaction between the components. The admixture is cured forming a shaped product.

There is no criticality in the order of mixing the constituents with the aggregate material except where a vaporous catalyst is used, in which case the catalyst is passed through the admixture after it is shaped. On the other hand, it is preferred to add the catalyst, in the case of the nobake process, as the last constituent of the composition so that premature reaction between the components does not take place. The components may be mixed with the aggregate material either simultaneously or one after the other in suitable mixing devices, such as mullers, continuous mixers, ribbon blenders and the like, while continuously stirring the admixture to insure uniform coating of aggregate particles. It is to be further understood that as a practical matter, the phenolic resole of the part 1 binder component can be stored separately and mixed with solvent just prior to use of or, if desirable, mixed with solvent and stored until ready to use. Such is also true with the polyisocyanate of the part 2 binder component. As a practical matter, the part 1 and part 2 binder components should not be brought into contact with each other until ready to use to prevent any possible premature reaction between them.

When the admixture is to be cured according to cold box process, the admixture after shaping as desired, is subjected to gassing with a vaporous catalyst as described above. Sufficient vaporous catalyst is passed through the shaped admixture to provide substantially complete reaction between the components. The flow rate of the vaporous catalyst is dependent, of course, on the size of the shaped admixture as well as the amount of binder therein.

In contrast, however, when the admixture is to be cured according to nobake process, the catalyst is generally added in liquid form to the aggregate material with the part 1 binder component. The admixture is then shaped and simply permitted to cure until reaction between the components is substantially complete, thus forming a shaped product such as a foundry core or mold. On the other hand, the liquid catalyst may also be admixed with the part 1 binder component prior to coating of the aggregate material with the components.

The quantity of binder can vary over a broad range sufficient to bind the refractory on curing of the binder. Generally, such quantity will vary from about 0.4 to about 6 weight percent of binder based on the weight of the aggregate and preferably about 0.5% to 3.0% by weight of the aggregate. The binder compositions of this invention may be employed by admixing the same with a wide variety of aggregate materials. When so employed, the amount of binder and aggregate can vary widely and is not critical. On the other hand, at least a binding amount of the binder composition should be present to coat substantially, completely and uniformly all of the sand particles and to provide a uniform admixture of the sand and binder. Thus, sufficient binder is present so that when the admixture is conveniently shaped as desired and cured, there is provided a strong, uniform, shaped article which is substantially uniformly cured throughout, thus minimizing breakage and warpage during handling of the shaped article, such as, for example, sand molds or cores, so made.

In testing embodiments of the present invention, tensile strengths of the cores prepared as noted above were determined using a Thwing-Albert Tensile Tester (Philadelphia, Pa.). This device consists of jaws that accommodate the ends of a "dog-bone-shaped" test core. A load is then applied to each end of the test core as the jaws are moved away from each other. The application of an increasing load continues until the test core breaks. The load at this point is termed the tensile strength, and it has units of psi (pounds per square inch).

The advantages of this invention and its preferred embodiments will be demonstrated more fully by the following Examples, that demonstrate the practice of the invention. In these Examples, and elsewhere throughout the specification, parts and percentages are by weight, and temperatures are in degrees Celsius, unless expressly indicated to be otherwise.

Test Cores—Cold Box Examples

Test cores were prepared by the following method: to a quantity of about 2.5 kg washed and dried aggregate material was added an amount of either a part 1 binder component or a modified part 1 binder component of the present invention and the mixture was stirred for about one minute in a Hobart Kitchen Aid Mixer. Next, a part 2 binder component was added to the mixture, which was then further mixed for another two minutes. This mixture was then used to form standard American Foundrymen Society's 1-inch dog bone tensile specimens in a standard core box employing a laboratory core blower. The cores were cured at room temperature using vaporous triethyl amine catalyst and the samples were broken at various time intervals after the mix was made. The cores were stored in an open laboratory environment, at ambient temperatures, until tested, or, as noted, the cores were stored in humidity chambers providing a specified humidity. Tensile strength measurements were made as described above. Average values for 3 tensile strength measurements were typically recorded. For the controls, the average results of five separate sand tests are reported. The times listed in the tables below for the tensile strength results refer to the core age at the time of testing.

In the testing of cold box binders, the tensile strength development was determined both as a function of core age and as a function of sand mix age. This latter test is referred to as bench life testing. In bench life testing, a portion of the sand/binder mixture is allowed to age under ambient conditions. At periodic intervals after the mixture has been made, portions of the sand/binder mixture are used to make cores for testing of tensile strength. It is typical that some degradation of tensile strength of a cured core will occur as a function of the age of the sand/binder mixture.

Test Cores—Nobake Examples

Test cores were prepared by the following method: to a quantity of about 2.5 kg washed and dried aggregate material was added an amount of either a part 1 binder component or a modified part 1 binder component of the present invention, a part 2 binder component and a liquid amine catalyst. This mixture was stirred for about one minute in a Hobart Kitchen Aid Mixer and then used immediately to form standard American Foundrymen Society's 1-inch dog bone tensile specimens in a Dietert 696 core box. The cores were cured at room temperature using a liquid amine catalyst and the samples were broken at various time intervals after the mix was made. The cores were stored in an open laboratory environment, at ambient temperatures, until tested, or, as noted, the cores were stored in humidity chambers providing a specified humidity. Tensile strength measurements were made as described above. Average values for 3 tensile strength measurements were typically recorded. The times listed in the tables below for the tensile strength results refer to the core age at the time of testing.

The humidity chambers used in both the cold box and nobake testing are typical of the type of chambers known in the art. Glass chambers, generally glass dessicators, are used as the humidity chambers. Either water or solutions of water and glycerol are used to generate a relatively constant humidity environment in the glass chambers.

EXAMPLE 1

Effecting of Adding Hydrofluoric Acid and Silica Gel to a Cold Box Binder

In this example, the effect of adding varying amounts of both hydrofluoric acid and silica gel on humidity resistance was determined. The control included a binder employing no hydrofluoric acid and no silica gel. For these tests, a 48% w/w aqueous solution of hydrofluoric acid, available from Aldrich Chemical Company, Milwaukee, Wis., was used. The silica gel used was Grade 63 silica gel, available from Fischer Scientific Company, Hanover Park, Ill. Where their use is noted, the fluoride bearing acid and the inorganic silicon compound were mixed with the part 1 binder component to form a liquid mixture having a viscosity similar to the viscosity of the control part 1 binder component. The aggregate used was Wedron 530. The total binder used was 1.0%, based on the weight of sand. The ratio of part 1 binder component to part 2 binder component was 55:45. The part 1 binder component was SIGMA CURE 7121 and the part 2 binder component was SIGMA CURE 7515. Both part 1 and part 2 components contained a small amount of an organosilane.

TABLE 1

Tensile Strength Improvement In Cold Box Process

| | | | | | | | |
|---|---|---|---|---|---|---|---|
| Part 1 | 7121 | 7121 | 7121 | 7121 | 7121 | 7121 | 7121 |
| Part 2 | 7515 | 7515 | 7515 | 7515 | 7515 | 7515 | 7515 |
| HF Addition, % | 0% | 0.1% | 0.2% | 0.3% | 0.4% | 0.5% | 0.6% |
| Silica Gel Addition, % | 0% | 0.2% | 0.2% | 0.2% | 0.2% | 0.2% | 0.4% |
| Tensile Strength, psi | | | | | | | |
| 1 minute | 190 | 180 | 191 | 206 | 189 | 188 | 201 |
| 1 hour | 250 | 239 | 234 | 257 | 261 | 269 | 255 |
| 24 hours | 263 | 252 | 259 | 294 | 273 | 273 | 276 |
| Tensile Strength, psi, at 100% Relative Humidity | | | | | | | |
| 2 hours | 104 | 89 | 113 | 181 | 189 | 188 | 160 |
| 24 hours | 89 | 116 | 98 | 175 | 183 | 184 | 167 |
| Bench Life Tensile, psi (One hour sand age) | | | | | | | |
| 1 minute | 164 | 165 | 174 | 196 | 183 | 176 | 183 |

The data of table 1 demonstrates an unexpected improvement in humidity resistance of as much as 107%. As described in table 1, cores made according to the principles of the present invention, and a control, were stored in a humidity chamber providing an environment of 100% relative humidity for either 2 hours or 24 hours. At the end of these time periods the cores tensile strength was determined.

EXAMPLE 2

Effecting of Adding Hydrofluoric Acid and Silica Gel to a Cold Box Binder

In this example, as in example 1 above, the effect of adding varying amounts of both hydrofluoric acid and silica gel on humidity resistance was determined. The control included a binder employing no hydrofluoric acid and no silica gel. For these tests, a 48% w/w aqueous solution of hydrofluoric acid, available from Aldrich Chemical Company, Milwaukee, Wis., was used. The silica gel used was catalog no. 28859-4, available from Aldrich Chemical Company, Milwaukee, Wis. Where their use is noted, the fluoride bearing acid and the inorganic silicon compound were mixed with the part 1 binder component to form a liquid mixture having a viscosity similar to the viscosity of the control part 1 binder component. The aggregate used was Wedron 530. The total binder used was 1.0%, based on the weight of sand. The ratio of part 1 binder component to part 2 binder component was 55:45. The part 1 binder component was SIGMA CURE 7121 and the part 2 binder component was SIGMA CURE 7515. Both part 1 and part 2 components contained a small amount of an organosilane.

TABLE 2

Tensile Strength Improvement In Cold Box Process

| | | | | | | | |
|---|---|---|---|---|---|---|---|
| Part 1 | 7121 | 7121 | 7121 | 7121 | 7121 | 7121 | 7121 |
| Part 2 | 7515 | 7515 | 7515 | 7515 | 7515 | 7515 | 7515 |
| HF Addition, % | 0% | 0.3% | 0% | 0% | 0.3% | 0.3% | 0.3% |
| Silica Gel Addition, % | 0% | 0% | 0.2% | 1.0% | 0.1% | 0.2% | 0.3% |
| Tensile Strength, psi | | | | | | | |
| 1 minute | 190 | 182 | 186 | 185 | 193 | 191 | 194 |
| 1 hour | 250 | 247 | 259 | 241 | 269 | 255 | 257 |
| 24 hours | 263 | 252 | 266 | 262 | 269 | 273 | 259 |
| Tensile Strength, psi, at 100% Relative Humidity | | | | | | | |
| 2 hours | 104 | 128 | 80 | 91 | 208 | 202 | 204 |
| 24 hours | 89 | 136 | 84 | 98 | 173 | 149 | 178 |
| Bench Life Tensile Strength, psi (one hour sand age) | | | | | | | |
| 1 minute | 164 | 166 | 176 | 183 | 174 | 183 | 182 |

The data of table 2 demonstrates an unexpected improvement of in humidity resistance of as much as 100%. By comparison to table 1 above, the data of table 2 also demonstrates that lesser amounts of hydrofluoric acid and silica gel are effective in generating dramatic increases in humidity resistance. The data of tables 1 and 2 also demonstrate that different grades of silica gel are equally effective in providing these improvements in humidity resistance. As described above, cores made according to the principles of the present invention, and a control, were stored in a humidity chamber providing an environment of 100% relative humidity for either 2 hours or 24 hours. At the end of these time periods the cores tensile strength was determined.

EXAMPLE 3

Effecting of Adding Hydrofluoric Acid and Silica Gel to a Cold Box Binder

In this example, the effect of adding reduced and varying amounts of silica gel, in combination with hydrofluoric acid, on humidity resistance was determined. The control included a binder employing no hydrofluoric acid and no silica gel. For these tests, a 48% w/w aqueous solution of hydrofluoric acid, available from Aldrich Chemical Company, Milwaukee, Wis., was used. The silica gel used was catalog no. 28859-4 silica gel, available from Aldrich Chemical Company, Milwaukee, Wis. Where their use is noted, the fluoride bearing acid and the inorganic silicon compound were mixed with the part 1 binder component to form a liquid mixture having a viscosity similar to the viscosity of the control part 1 binder component. The aggregate used was Wedron 530. The total binder used was 1.0%, based on the weight of sand. The ratio of part 1 binder component to part 2 binder component was 55:45. The part 1 binder component was SIGMA CURE 7121 and the part 2 binder component was SIGMA CURE 7515. Both part 1 and part 2 components contained a small amount of an organosilane.

TABLE 3

Tensile Strength Improvement In Cold Box Process

| | | | | | | | |
|---|---|---|---|---|---|---|---|
| Part 1 | 7121 | 7121 | 7121 | 7121 | 7121 | 7121 | 7121 |
| Part 2 | 7515 | 7515 | 7515 | 7515 | 7515 | 7515 | 7515 |
| HF Addition, % | 0% | 0.3% | 0.3% | 0.3% | 0.3% | 0.3% | 0.3% |
| Silica Gel Addition, % | 0% | 0.01% | 0.02% | 0.03% | 0.05% | 0.1% | 0.2% |
| Tensile Strength, psi | | | | | | | |
| 1 minute | 190 | 195 | 204 | 189 | 195 | 215 | 206 |
| 1 hour | 250 | 255 | 252 | 249 | 264 | 250 | 257 |
| 24 hours | 263 | 260 | 271 | 265 | 277 | 295 | 294 |
| Tensile Strength, psi, at 100% Relative Humidity | | | | | | | |
| 2 hours | 104 | 152 | 154 | 164 | 173 | 187 | 181 |
| 24 hours | 89 | 107 | 140 | 151 | 167 | 189 | 175 |
| Bench Life Tensile Strength, psi (one hour sand age) | | | | | | | |
| 1 minute | 164 | 173 | 192 | 173 | 186 | 190 | 196 |

The data of table 3 demonstrates an unexpected improvement in humidity resistance of as much as 112%. By comparison to table 1 and 2 above, the data of table 3 also demonstrates that very low amounts of silica gel, when used with a fluoride bearing acid, are effective in generating dramatic increases in humidity resistance.

EXAMPLE 4

Effecting of Different Sources of Silicon

In this example, the effect of adding silicon from different sources on humidity resistance was determined. The control included a binder employing no hydrofluoric acid and no silica gel. For these tests, a 48% w/w aqueous solution of hydrofluoric acid, available from Aldrich Chemical Company, Milwaukee, Wis., was used. Where noted, ferrosilicon, available from Hickman, Williams and Company, was used. Where noted, iron silicide, available from Aldrich Chemical Company, Milwaukee, Wis., was used. Where noted, talc, which is hydrous magnesium silicate, and calcium silicate, both available from Aldrich Chemical Company, were used. Where noted, VEINGUARD, available from Borden Chemical Company, Louisville, Ky., was used. Where their use is noted, the fluoride bearing acid and the inorganic silicon compound were mixed with the part 1 binder component to form a liquid mixture having a viscosity similar to the viscosity of the control part 1 binder component. The aggregate used was Wedron 530. The total binder used was 1.0%, based on the weight of sand. The ratio of part 1 binder component to part 2 binder component was 55:45. The part 1 binder component was SIGMA CURE 7121 and the part 2 binder component was SIGMA CURE 7515. Both part 1 and part 2 components contained a small amount of an organosilane.

TABLE 4

Tensile Strength Improvement In Cold Box Process

| | | | | | | |
|---|---|---|---|---|---|---|
| Part 1 | 7121 | 7121 | 7121 | 7121 | 7121 | 7121 |
| Part 2 | 7515 | 7515 | 7515 | 7515 | 7515 | 7515 |
| HF Addition, % | 0% | 0.3% | 0.3% | 0.3% | 0.3% | 0.5% |
| Source of Silicon, % | 0% | Ferro-silicon, 0.2% | Iron Silicide, 0.2% | Talc, 0.2% | Calcium Silicate, 0.2% | VEIN-QUARD, 0.2% |
| Tensile Strength, psi | | | | | | |
| 1 minute | 190 | 196 | 186 | 181 | 190 | 183 |
| 1 hour | 250 | 244 | 250 | 220 | 230 | 225 |
| 24 hours | 263 | 291 | 291 | 268 | 261 | 249 |
| Tensile Strength, psi, at 100% Relative Humidity | | | | | | |
| 2 hours | 104 | 162 | 164 | 136 | 147 | 96 |
| 24 hours | 89 | 146 | 164 | 135 | 122 | 112 |
| Bench Life Tensile, psi (one hour sand age) | | | | | | |
| 1 minute | 164 | 170 | 160 | 164 | 163 | 170 |

The data of table 4 demonstrates an unexpected improvement of in humidity resistance of as much as 84%. By comparison to tables 1, 2 and 3 above, the data of table 4 also demonstrates that different sources of silicon, when used with a fluoride bearing acid, are effective in generating increases in humidity resistance. As described above, cores were stored in a humidity chamber providing an environment of 100% relative humidity for either 2 hours or 24 hours. At the end of these time periods the cores tensile strength was determined.

EXAMPLE 5

Further Examples of the Effect of Different Sources of Silicon

In this example, the effect of adding silicon from different sources on humidity resistance was determined. The control included a binder employing no hydrofluoric acid and no inorganic silicon compound. For these tests, a 48% w/w aqueous solution of hydrofluoric acid, available from Aldrich Chemical Company, Milwaukee, Wis., was used. The silica gel used was either Grade 63 silica gel, available from Fischer Scientific Company, Hanover Park, Ill. or catalog no. 28859-4 silica gel ("Silica Gel Grade 60") available from Aldrich Chemical Company. Where noted, ALUSIL, a sodium aluminosilicate, available from Crosfield Corporation, Warrington, United Kingdom, was used. Where noted, colloidal silica, available from Akzo Nobel, Marietta, Ga., under the tradename NYACOL 9950, was used. Where noted, sodium silicate as "liquid grade 40" from OxyChem Corporation, Dallas, Tex., was used. Where their use is noted, the fluoride bearing acid and the inorganic silicon compound were mixed with the part 1 binder component to form a liquid mixture having a viscosity similar to the viscosity of the control part 1 binder component. The aggregate used was Wedron 530. The total binder used was 1.0%, based on the weight of sand. The ratio of part 1 binder component to part 2 binder component was 55:45. The part 1 binder component was SIGMA CURE 7121 and the part 2 binder component was SIGMA CURE 7515. Both part 1 and part 2 components contained a small amount of an organosilane.

TABLE 5

Tensile Strength Improvement In Cold Box Process

| | | | | | | | |
|---|---|---|---|---|---|---|---|
| Part 1 | 7121 | 7121 | 7121 | 7121 | 7121 | 7121 | 7121 |
| Part 2 | 7515 | 7515 | 7515 | 7515 | 7515 | 7515 | 7515 |
| HF Addition, % | 0% | 0.3% | 0.3% | 0.3% | 0.5% | 0.6% | 0.3% |
| Source of Silicon, % | 0% | Silica Gel Grade 63, 0.2% | Silica Gel Grade 60, 0.2% | Alusil ET, 0.2% | Colloidal Silica, 0.4% | Sodium Silicate, 0.5% | Silicon 0.2% |
| Tensile Strength, psi | | | | | | | |
| 1 minute | 190 | 188 | 189 | 178 | 192 | 199 | 189 |
| 1 hour | 250 | 245 | 255 | 243 | 264 | 249 | 234 |
| 24 hours | 263 | 279 | 284 | 285 | 285 | 263 | 240 |
| Tensile Strength, psi, at 100% Relative Humidity | | | | | | | |
| 2 hours | 104 | 164 | 217 | 164 | 218 | 125 | 141 |
| 24 hours | 89 | 161 | 198 | 141 | 197 | 113 | 145 |
| Bench Life Tensile, psi (one hour sand age) | | | | | | | |
| 1 minute | 164 | 185 | 183 | 175 | 178 | 189 | 175 |

The data of table 5 demonstrates an unexpected improvement of in humidity resistance of as much as 122%. By comparison to tables 1 through 4 above, the data of table 5 also demonstrates that different sources of silicon are effective in generating increases in humidity resistance. As described above, cores were stored in a humidity chamber providing an environment of 100% relative humidity for either 2 hours or 24 hours. At the end of these time periods the cores tensile strength was determined. Consistent with the results preset in tables 1 through 3, it can be seen by the data of table 5 that the present invention also results in an improved bench life.

EXAMPLE 6

Further Examples of the Effect of Different Sources of Silicon

In this example, the effect of adding silicon from different sources on humidity resistance was determined. The control included a binder employing no hydrofluoric acid and no silica gel. For these tests, a 48% w/w aqueous solution of hydrofluoric acid, available from Aldrich Chemical Company, Milwaukee, Wis., was used. The silica gel used was catalog no. 28859-4 silica gel ("Silica Gel 60"), available from Aldrich Chemical Company. Where noted, ground soda glass or fumed silica were used. These materials are generally available as known in the art. Where their use is noted, the fluoride bearing acid and the inorganic silicon compound were mixed with the part 1 binder component to form a liquid mixture having a viscosity similar to the viscosity of the control part 1 binder component. The aggregate used was Wedron 530. The total binder used was 1.0%, based on the weight of sand. The ratio of part 1 binder component to part 2 binder component was 55:45. The part 1 binder component was SIGMA CURE PM14 and the part 2 binder component was SIGMA CURE PM25. Both part 1 and part 2 components contained a small amount of an organosilane.

TABLE 6

Tensile Strength Improvement In Cold Box Process

| | | | | | |
|---|---|---|---|---|---|
| Part 1 | PM14 | PM14 | PM14 | PM14 | PM14 |
| Part 2 | PM25 | PM25 | PM25 | PM25 | PM25 |
| HF Addition, % | 0% | 0.3% | 0.3% | 0.3% | 0.3% |
| Source of Silicon, % | 0% | Ground Soda Glass 0.2% | Fused Silica 0.2% | Silica Gel 60 0.2% | Silica Gel 60 0.1% |
| Tensile Strength, psi | | | | | |
| 1 minute | 202 | 202 | 203 | 213 | 202 |
| 1 hour | 290 | 270 | 264 | 291 | 278 |
| 24 hours | 257 | 308 | 292 | 275 | 294 |
| Tensile Strength, psi, at 100% Relative Humidity | | | | | |
| 2 hours | 123 | 136 | 134 | 151 | 150 |
| 24 hours | 44 | 114 | 130 | 108 | 129 |
| Bench Life Tensile Strength, psi (one hour sand age) | | | | | |
| 1 minute | 194 | 192 | 197 | 183 | 198 |

The data of table 6 demonstrates an unexpected improvement in humidity resistance of as much as 195%. The data of table 6 also demonstrates that different sources of silicon are effective in generating increases in humidity resistance. As described above, cores made according to the principles of the present invention, and a control, were stored in a humidity chamber providing an environment of 100% relative humidity for either 2 hours or 24 hours. At the end of these time periods the cores tensile strength was determined.

EXAMPLE 7

Effect of Adding Fluorosilicic Acid or Fluoroboric Acid

In this example, the effect of adding fluorosilicic acid or fluoroboric acid in place of hydrofluoric acid on humidity resistance was determined. The control included a binder employing no hydrofluoric acid and no inorganic silicon compound. For these tests, either a 20–25% w/w aqueous solution of fluorosilicic acid, or a 48% w/w aqueous solution of fluoroboric acid, both available from Aldrich Chemical Company, Milwaukee, Wis., were used. Silica gel, available as catalog no. 28859-4 also from Aldrich Chemical Company, was used. Where their use is noted, the fluoride bearing acid and the inorganic silicon compound were mixed with the part 1 binder component to form a liquid mixture having a viscosity similar to the viscosity of the control part 1 binder component. The aggregate used was Wedron 530. The total binder used was 1.0%, based on the weight of sand. The ratio of part 1 binder component to part 2 binder component was 55:45. The part 1 binder component was SIGMA CURE 7121 and the part 2 binder component was SIGMA CURE 7515. Both part 1 and part 2 components contained a small amount of an organosilane.

TABLE 7

Tensile Strength Improvement In Cold Box Process

| | | | |
|---|---|---|---|
| Part 1 | 7121 | 7121 | 7121 |
| Part 2 | 7515 | 7515 | 7515 |
| Acid Addition, % | 0% | 0.4%[1] | 0.3%[2] |
| Silica Gel, % | 0% | 0.2% | 0.2% |
| Tensile Strength, psi | | | |
| 1 minute | 190 | 194 | 168 |
| 1 hour | 250 | 262 | 234 |
| 24 hours | 263 | 258 | 252 |
| Tensile Strength, psi, at 100% Relative Humidity | | | |
| 2 hours | 104 | 127 | 173 |
| 24 hours | 89 | 104 | 159 |
| Bench Life Tensile Strength, psi (one hour sand age) | | | |
| 1 minute | 164 | 169 | 157 |

[1]Acid used was fluorosilicic acid.
[2]Acid used was fluoroboric acid.

The data of table 7 demonstrates that, surprisingly, fluorosilicic acid or fluoroboric acid in combination with silica gel provides an unexpected improvement of in humidity resistance of as much as 79%. As described above, cores made according to the principles of the present invention, and a control, were stored in a humidity chamber providing an environment of 100% relative humidity for either 2 hours or 24 hours. At the end of these time periods the cores tensile strength was determined.

EXAMPLE 8

Effect of Different Mixing Methodologies

In this example, the effect of adding hydrofluoric acid and silica gel to the different components used in making a mixture of binder and aggregate on humidity resistance was determined. The control included a binder employing no fluoride bearing acid and no silicon bearing compound. For these tests, a 48% w/w aqueous solution of hydrofluoric acid, available from Aldrich Chemical Company, Milwaukee, Wis., was used. The silica gel used was catalog no. 28859-4, also available from Aldrich Chemical Company. Unless otherwise noted, the fluoride bearing acid and the inorganic silicon compound were mixed with the part 1 binder component to form a liquid mixture having a viscosity similar to the viscosity of the control part 1 binder component. The aggregate used was Wedron 530. The total binder used was 1.0%, based on the weight of sand. The ratio of part 1 binder component to part 2 binder component was 55:45. The part 1 binder component was SIGMA CURE 7121 and the part 2 binder component was SIGMA CURE 7515. Both part 1 and part 2 components contained a small amount of an organosilane.

The hydrofluoric acid and the silica gel were added according to the following methodologies. The purpose of these tests was to determine whether the point of addition of the additives of the present invention was determinative as to the results produced in tensile strength improvements.

Methodologies for Adding Hydrofluoric Acid and Silica Gel

| Methodology | Description |
|---|---|
| A | Control - no additives used |
| B | Both additives in the part 1 binder component |
| C | Hydrofluoric acid and silica gel were combined and reacted to form a pre-mix. The pre-mix was then added to the part 1 binder component. |
| D | Hydrofluoric acid was added to the part 1 binder component. Silica gel was added to the part 2 binder component. |
| E | Hydrofluoric acid was added to the aggregate, mixed, and allowed to stand for one minute before being mixed with the binder components. Silica gel was added to the part 1 binder component. An unmodified part 2 binder component was used. |
| F | Silica gel was added to the aggregate and mixed for one minute before being mixed with the binder components. Hydrofluoric acid was added to the part 1 binder component. An unmodified part 2 binder component was used. |

TABLE 8

Tensile Strength Improvement In Cold Box Process

| | | | | | | |
|---|---|---|---|---|---|---|
| Part 1 | 7121 | 7121 | 7121 | 7121 | 7121 | 7121 |
| Part 2 | 7515 | 7515 | 7515 | 7515 | 7515 | 7515 |
| HF Addition, % | 0% | 0.3% | 0.3% | 0.3% | 1% | 0.3% |
| Silica Gel Addition, % | 0% | 0.2% | 0.2% | 0.2% | 0.2% | 3.5% |
| Methodology | A | B | C | D | E | F |
| Tensile Strength, psi | | | | | | |
| 1 minute | 190 | 206 | 192 | 184 | 198 | 185 |
| 1 hour | 250 | 257 | 250 | 241 | 261 | 247 |
| 24 hours | 263 | 294 | 292 | 252 | 254 | 253 |
| Tensile Strength, psi, at 100% Relative Humidity | | | | | | |
| 2 hours | 104 | 181 | 173 | 84 | 59 | 118 |
| 24 hours | 89 | 175 | 152 | 90 | 65 | 101 |
| Bench Life Tensile, psi (one hour sand age) | | | | | | |
| 1 minute | 164 | 196 | 167 | 166 | 171 | 185 |

The data of table 8 demonstrates that combining the additives of the present invention with the part 1 binder component, either individually, or after first reacting the additives in a pre-mix, produces unexpected improvements in humidity resistance. As described in table 1, cores made according to the principles of the present invention, and a control, were stored in a humidity chamber providing an environment of 100% relative humidity for either 2 hours or 24 hours. At the end of these time periods the cores tensile strength was determined.

EXAMPLE 9

Effect of Adding Non-Silicon Additives

In this example, the effect of adding boric acid in place of an inorganic silicon compound on humidity resistance was determined. The control included a binder employing no hydrofluoric acid and no boric acid. For these tests, a 48% w/w aqueous solution of hydrofluoric acid was used. Commercial grade boric acid was used. This material is generally available as known in the art. Where their use is noted, the fluoride bearing acid and the boron compound were mixed with the part 1 binder component to form a liquid mixture having a viscosity similar to the viscosity of the control part 1 binder component. The aggregate used was Wedron 530. The total binder used was 1.0%, based on the weight of sand. The ratio of part 1 binder component to part 2 binder component was 55:45. The part 1 binder component was SIGMA CURE 7121 and the part 2 binder component was SIGMA CURE 7515. Both part 1 and part 2 components contained a small amount of an organosilane.

TABLE 9

Tensile Strength Improvement In Cold Box Process

| | | |
|---|---|---|
| Part 1 | 7121 | 7121 |
| Part 2 | 7515 | 7515 |
| HF Addition, % | 0% | 0.5% |
| Additive, % | 0% | Boric Acid, 0.5% |
| Tensile Strength, psi | | |
| 1 minute | 190 | 168 |
| 1 hour | 250 | 247 |
| 24 hours | 263 | 278 |
| Tensile Strength, psi, at 100% Relative Humidity | | |
| 2 hours | 104 | 192 |
| 24 hours | 89 | 164 |
| Bench Life Tensile Strength, psi (one hour sand age) | | |
| 1 minute | 164 | 167 |

The data of table 9 demonstrates that, surprisingly, the use of boric acid provides an unexpected improvement of in humidity resistance of as much as 84%. As described above, cores made according to the principles of the present invention, and a control, were stored in a humidity chamber providing an environment of 100% relative humidity for either 2 hours or 24 hours. At the end of these time periods the cores tensile strength was determined.

EXAMPLE 10

Effecting of Silane on Embodiments of the Present Invention

In this example, the effect of adding silane to the combination of the present invention on humidity resistance was determined. The control included a binder employing no hydrofluoric acid and no silica gel, and 0.4% silane. For these tests, hydrofluoric acid and silica gel, each as described above, were used. Two commercially available organosilanes were used. These organosilanes are sold, respectively, under the tradenames A-187 and A-1160, available from Witco Corporation, Friendly, W.Va. The test results listed are the average of five sand test results. Where their use is noted, the fluoride bearing acid and the inorganic silicon compound were mixed with the part 1 binder component to form a liquid mixture having a viscosity similar to the viscosity of the control part 1 binder component. The aggregate used was Wedron 530. The total binder used was 1.0%, based on the weight of sand. The ratio of part 1 binder component to part 2 binder component was 55:45. The part 1 binder component was SIGMA CURE 7121 and the part 2 binder component was SIGMA CURE 7515. Both part 1 and part 2 components contained a small amount of an organosilane, unless otherwise noted.

TABLE 10

Tensile Strength Improvement In Cold Box Process

| | | | | |
|---|---|---|---|---|
| Part 1 | 7121 | 7121 | 7121 | 7121 |
| Part 2 | 7515 | 7515 | 7515 | 7515 |
| HF Addition, % | 0% | 0.3% | 0.3% | 0.3% |
| Silica Gel, % | 0% | 0.2% | 0.2% | 0.2% |
| Silane Addition, % | A-187, 0.4% | A-187, 0.4% | A-1160, 0.4% | 0% |
| Tensile Strength, psi | | | | |
| 1 minute | 190 | 191 | 203 | 205 |
| 1 hour | 250 | 255 | 278 | 269 |
| 24 hours | 263 | 269 | 273 | 234 |
| Tensile Strength, psi, at 100% Relative Humidity | | | | |
| 2 hours | 104 | 202 | 184 | 96 |
| 24 hours | 89 | 184 | 149 | 30 |
| Bench Life Tensile, psi (one hour sand age) | | | | |
| 1 minute | 164 | 183 | 194 | 186 |

The data of table 10 demonstrate a surprising synergy due to the combination of organosilane, hydrofluoric acid and silica gel. By comparison to the controls of the previous examples, it is clear that the combination of hydrofluoric acid and silica gel produces the greatest improvement in humidity resistance when used in combination with an organosilane. This effect is larger than the effect of using either the hydrofluoric acid/silica gel combination or the organosilane alone.

EXAMPLE 11

Effect of Adding Hydrofluoric Acid and Silica Gel to a Nobake Binder

In this example, the effect of adding hydrofluoric acid and silica gel on humidity resistance in a nobake binder was determined. The control included a binder employing no hydrofluoric acid and silica gel. For these tests, a 48% w/w aqueous solution of hydrofluoric acid, available from Aldrich Chemical Company, Milwaukee, Wis., was used at 0.3%. The silica gel used was catalog no. 28859-4 silica gel, also available from Aldrich Chemical Company, and was at 0.2%. Where their use is noted, the fluoride bearing acid and the inorganic silicon compound were mixed with the part 1 binder component to form a liquid mixture having a viscosity similar to the viscosity of the control part 1 binder component. The aggregate used was Nugent 480 sand. The total binder used was 1.5%, based on the weight of sand. The ratio of part 1 binder component to part 2 binder component was 55:45. The part 1 binder component was SIGMA SET 6100 and the part 2 binder component was SIGMA SET 6500. Both part 1 and part 2 components contained a small amount of an organosilane. A liquid amine catalyst, SIGMA SET 6720, which is 20% w/w of phenylpropylpyridine in an aromatic solvent, was added at 2.25% based on the total binder weight.

TABLE 11

Tensile Strength Improvement In Nobake Process

| | Control | With Hydrofluoric Acid and Silica Gel |
|---|---|---|
| Part 1 | Sigma Set 6100 | Sigma Set 6100 |
| Part 2 | Sigma Set 6500 | Sigma Set 6500 |
| Catalyst | Catalyst 6720 | Catalyst 6720 |
| Strip Time | 8 minutes 20 seconds | 10 minutes 28 seconds |
| Tensile Strength, psi | | |
| 10 Minutes | 132 | 111 |
| 1 hour | 273 | 304 |
| 24 hours | 420 | 413 |
| 24 hours, 90% Relative Humidity | 128 | 191 |

The data of table 11 demonstrate an improved in the tensile strength of dog bones of about 49% when hydrofluoric acid and silica gel are added to a nobake binder.

A review of the results provided in tables 1 through 11 above also demonstrates several additional benefits of the present invention. The use of the combination of a fluoride bearing acid and a silicon or boron compound in the binders of the present invention, does not adversely affect the other strength parameters of cured cores and molds. In fact, it can be seen that the 24 hour tensile strength of cores made according to the principles of the present invention can be greater than the corresponding strengths of the control cores. Also, the bench life can demonstrate a similar improvement. Accordingly, the present invention provides improved humidity resistance for foundry cores and mold without sacrificing other important properties of such cores and molds.

There has been provided in accordance with the present invention, an improved phenolic urethane binder composition useful for binding foundry cores and molds. There has also been provided in accordance with the present invention, a method for improving the strength and humidity resistance of a phenolic urethane resin and the foundry cores and molds made using such an improved binder composition. There is further provided in accordance with the present invention, a composition relating to the reaction product of a resole, an acid fluoride and a silicon dioxide. There is still further provided in accordance with the present invention a composition relating to the reaction product of an acid fluoride and a silicon dioxide. While the invention has been described with specific embodiments and many alternatives, modifications and variations will be apparent to those skilled in the art in light of the foregoing description. Accordingly, it is intended to include all such alternatives, modifications and variations set forth within the spirit and scope of the appended claims.

What is claimed is:

1. A part 1 phenolic urethane binder component for use with a part 2 phenolic urethane binder component and an organosilane, the part 1 phenolic urethane binder component comprising:

a phenolic resole;

a fluoride bearing acid; and an inorganic oxide of silicon.

2. The part 1 phenolic urethane binder component of claim 1 wherein the fluoride bearing acid is present in an amount ranging from about 0.1% to about 2%, calculated as hydrogen fluoride and based on the weight of the part 1 phenolic urethane binder component.

3. The part 1 phenolic urethane binder component of claim 1 wherein the fluoride bearing acid is present in an amount ranging from about 0.1% to about 0.8%, calculated as hydrogen fluoride and based on the weight of the part 1 phenolic urethane binder component.

4. The part 1 phenolic urethane binder component of claim 1 wherein the inorganic oxide of silicon is present in an amount ranging from about 0.01% to about 1%, calculated as silicon and based on the weight of the part 1 phenolic urethane binder component.

5. The part 1 phenolic urethane binder component of claim 1 wherein the inorganic oxide of silicon is present in an amount ranging from about 0.02% to about 0.5%, calculated as silicon and based on the weight of the part 1 phenolic urethane binder component.

6. The part 1 phenolic urethane binder component of claim 1 wherein the inorganic oxide of silicon is selected from the group consisting of silica flour, silica gel, colloidal silica, fumed silica, ground soda glass, sodium silicate, potassium silicate, calcium silicate, magnesium silicate, sodium aluminosilicate, and combinations thereof.

7. The part 1 phenolic urethane binder component of claim 1 wherein the fluoride bearing acid is hydrofluoric acid.

8. The part 1 phenolic urethane binder component of claim 1 wherein the fluoride bearing acid is selected from the group consisting of fluorosilicic acid and fluoriboric acid.

9. The part 1 phenolic urethane binder component of claim 1 wherein the organosilane compound is mixed with the part 1 phenolic urethane binder component.

10. A product of a process, the product for use with a part 2 phenolic urethane binder component and an organosilane, the process comprising:

mixing and reacting:
- a phenolic resole;
- a fluoride bearing acid; and
- an inorganic oxide of silicon.

11. The product of claim 10 wherein the fluoride bearing acid is present in an amount ranging from about 0.1% to about 2%, calculated as hydrogen fluoride and based on the weight of the product.

12. The product of claim 10 wherein the fluoride bearing acid is present in an amount ranging from about 0.1% to about 0.8%, calculated as hydrogen fluoride and based on the weight of the product.

13. The product of claim 10 wherein the inorganic oxide of silicon is present in an amount ranging from about 0.01% to about 1%, calculated as silicon and based on the weight of the product.

14. The product of claim 10 wherein the inorganic oxide of silicon is present in an amount ranging from about 0.02% to about 0.5%, calculated as silicon and based on the weight of the part 1 product.

15. The product of claim 10 wherein the inorganic oxide of silicon is selected from the group consisting of silica flour, silica gel, colloidal silica, fumed silica, ground soda glass, sodium silicate, potassium silicate, calcium silicate, magnesium silicate, sodium aluminosilicate, and combinations thereof.

16. The product of claim 10 wherein the fluoride bearing acid is hydrofluoric acid.

17. A composition comprising:

a part 1 phenolic urethane binder component, the part 1 phenolic urethane binder component comprising:
- an inorganic oxide of silicon; and
- a fluoride bearing acid; and a part 2 phenolic urethane binder component;

aggregate; and an organosilane.

18. The composition of claim 17 wherein the fluoride bearing acid is present in an amount ranging from about 0.1% to about 2%, calculated as hydrogen fluoride and based on the weight of the part 1 phenolic urethane binder component.

19. The composition of claim 17 wherein the fluoride bearing acid is present in an amount ranging from about 0.1% to about 0.8%, calculated as hydrogen fluoride and based on the weight of the part 1 phenolic urethane binder component.

20. The composition of claim 17 wherein the inorganic oxide of silicon is present in an amount ranging from about 0.01% to about 1%, calculated as silicon and based on the weight of the part 1 phenolic urethane binder component.

21. The composition of claim 17 wherein the inorganic oxide of silicon is present in an amount ranging from about 0.02% to about 0.5%, calculated as silicon and based on the weight of the part 1 phenolic urethane binder component.

22. The composition of claim 17 wherein the inorganic oxide of silicon is selected from the group consisting of silica flour, silica gel, colloidal silica, fumed silica, ground soda glass, sodium silicate, potassium silicate, calcium silicate, magnesium silicate, sodium aluminosilicate, and combinations thereof.

23. The composition of claim 17 wherein the fluoride bearing acid is hydrofluoric acid.

* * * * *